United States Patent [19]

Fabbri et al.

[11] Patent Number: 5,038,254

[45] Date of Patent: Aug. 6, 1991

[54] INTEGRATED MEDICAL LIGHT SYSTEM

[75] Inventors: Wiliam C. Fabbri, Billerica; Roy Crane, Wilmington, both of Mass.

[73] Assignee: Keene Corporation, Union, N.J.

[21] Appl. No.: 629,436

[22] Filed: Dec. 18, 1990

[51] Int. Cl.[5] ..... F21V 13/00

[52] U.S. Cl. ..... 362/33; 362/225; 362/147; 362/804

[58] Field of Search ..... 362/33, 225, 240, 364, 362/147, 804

[56] References Cited

U.S. PATENT DOCUMENTS 3,928,757 12/1975 Nelson ..... 362/804 X 4,204,274 5/1980 Lüderitz ..... 362/225 X

*Primary Examiner*—Stephen F. Husar

*Attorney, Agent, or Firm*—Kane, Dalsimer, Sullivan, Kurucz, Levy, Eisele and Richard

[57] ABSTRACT

The apparatus is a medical lighting system which includes a ceiling-mount reading light, examination light and ambient light. The reading light is directed toward a selected reading area on a hospital bed directly below the medical lighting system. The examination light illluminates the entire top surface of the hospital bed. The ambient light directs light to a wall abutting the head of the hospital bed thereby providing reflected light to the vicinity of the hospital bed.

14 Claims, 2 Drawing Sheets

INTEGRATED MEDICAL LIGHT SYSTEM

BACKGROUND OF THE INVENTION

1. Field of the Invention

This invention pertains to a light system for use in hospitals and health facilities. The light system includes an examination light, an ambient light, and a reading light and is preferably mounted in the ceiling.

2. Description of the Prior Art

In hospitals and similar health or medical facilities, it is desirable to provide the bedridden patient with three types of lights—the first is an ambient light which provides background, preferably reflected, light to a large area surrounding the bed; the second is a reading light which provides direct light to a portion of the patient's bed; and the third is an examination light which directs a high intensity light to substantially the entire area of the patient's bed. The ambient light typically has an illumination value of approximately 50 foot-candles while the reading light typically has an illumination value of approximately 70 foot-candles and the examination light typically has an illumination value of approximately 100 foot-candles.

In the prior art, these lights were typically provided individually in a haphazard way. Different types of lamps and light fixtures were placed around the bed with numerous plugs competing with medical equipment for available outlet space. Moreover, such an arrangement was unsightly and could impede the mobility of the patient, the patient's bed, or the surrounding medical equipment.

Wall-mounted fixtures alleviated some of the above-identified deficiencies but still left much to be desired aesthetically and, more importantly, could impede access to the patient, and were easily damaged by motor driven bed headboards.

OBJECTS AND SUMMARY OF THE INVENTION

It is therefore an object of this invention to provide an integrated medical lighting system which provides an ambient light with an illumination value of about 50 foot-candles over a wide area; a reading light with an illumination value of about 70 foot-candles over an area appropriate for a patient reading in bed; and an examination light with an illumination value of about 100 foot-candles over the entire area of the patient's bed.

It is therefore a further object of this invention to provide an integrated medical lighting system which requires no more than one or two electrical connections.

It is therefore a still further object of this invention to provide an integrated medical lighting system which does not impede access to the patient, the patient's bed, or surrounding medical equipment.

It is therefore a final object of this invention to provide an integrated medical lighting system which is aesthetically pleasing.

These and other objects are effectively attained by providing a ceiling-mounted medical lighting system which includes three individual dedicated light fixtures. The lighting system is rectangular and is designed to be placed so that one of the shorter ends of the rectangle is placed substantially on the ceiling-wall interface directly over the head of the patient's bed. The bed is placed so that the longer sides of the bed are parallel to the longer sides of the rectangular light fixture.

A first light fixture includes a fluorescent bulb and a reflector designed to direct light toward the forward portion of the patient's bed so as to allow a patient to read comfortably. A second light fixture includes a fluorescent bulb and a reflector designed to direct light toward a vertical wall abutting the head of the patient's bed so as to provide a reflected light over a large area around the patient's bed. A third light fixture includes two to four fluorescent (preferably biax® or other U-shaped) bulbs which are oriented perpendicularly to the bed. The fluorescent bulbs have a light distribution pattern which is substantially oriented in the direction perpendicular to the bulb. Therefore, the entire area of the bed is efficiently illuminated providing an examination light.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
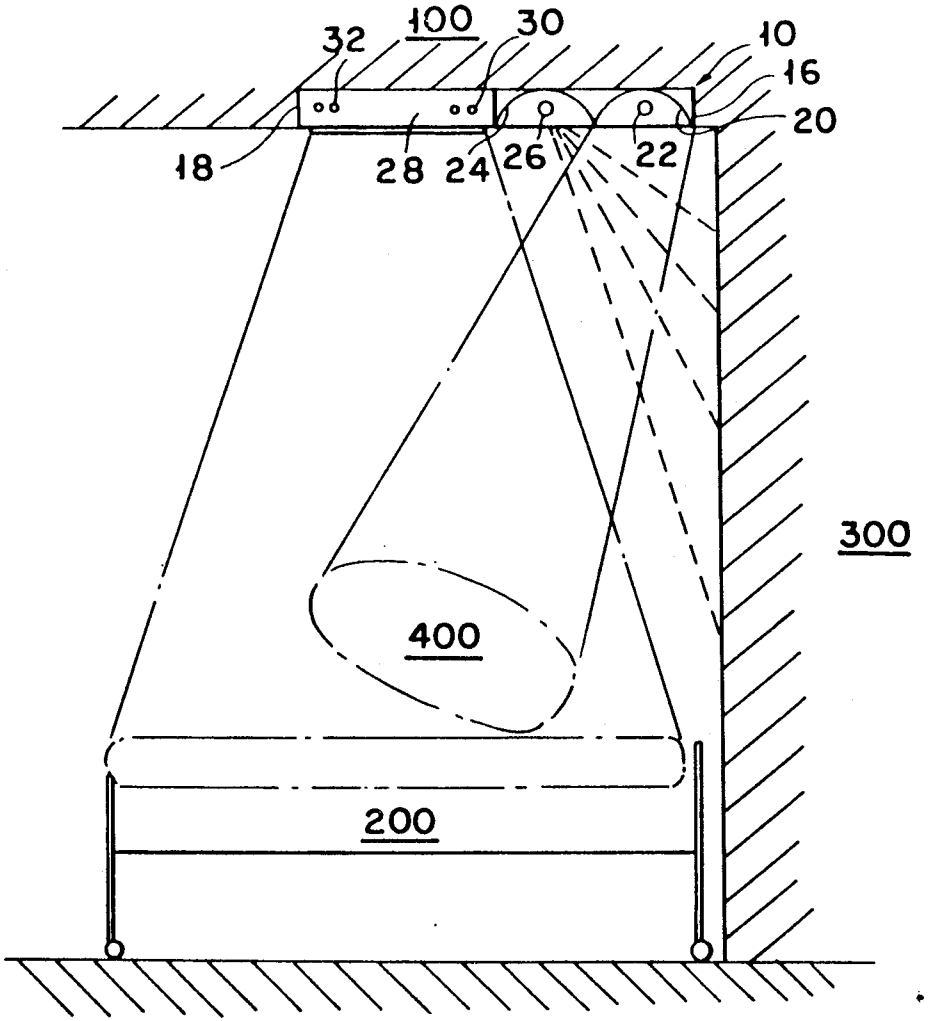
FIG. 1 is a side plan view of the integrated medical light system of the present invention.
Figure 2:
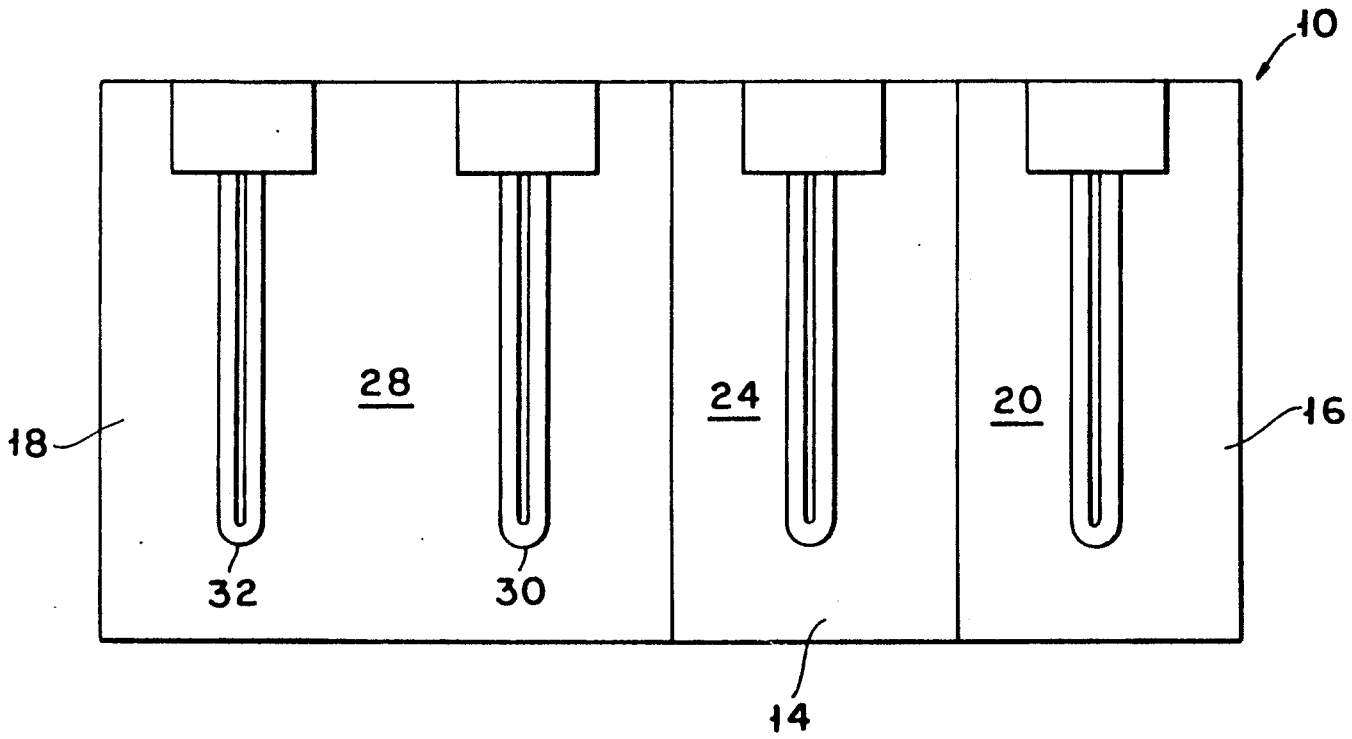
FIG. 2 is a bottom plan view of the integrated medical light system of the present invention.

Referring now to the drawings in detail wherein like numerals indicate like elements throughout the several views, FIG. 1 is a side plan view of lighting fixture 10 shown installed in ceiling 100 directly over bed 200. FIG. 2 shows the rectangular shape of lighting fixture 10 formed by long sides 12, 14 and short sides 16, 18. Long sides 12, 14 are typically four feet in length while short sides 16, 18 are typically two feet in length. As shown in FIG. 1, short side 16 abuts the wall-ceiling (300, 100, respectively) interface directly over the head of bed 200. Long sides 12, 14 are parallel to the longer side of bed 200.

Reading light reflector 20 is along short side 16 of lighting fixture 10 proximate to wall 300 and includes a fluorescent bulb 22 positioned therewithin parallel to short sides 16, 18 of lighting fixture 10 so as to provide a direct light to reading area 400 of bed 200 as shown on FIG. 1. Reflector 20 and bulb 22 are chosen to provide an illumination of approximately 70 foot-candles to reading are 400.

Ambient light reflector 24 is inwardly adjacent to reading light reflector 20 and includes a fluorescent bulb 26 positioned therewithin parallel to short sides 16, 18 of lighting fixture 10 so as to reflect or bounce light from wall 300 thereby providing ambient light to bed 200. Reflector 24 and bulb 26 are chosen to provide approximately 50 foot-candles of illumination to the ambient area.

Reflectors 20, 24 and bulbs 22, 26 are configured so as not to direct glare toward the head of bed 200 where the patient's head is likely to be, whether in a supine or sitting position. Similarly, reflectors 20, 24 and bulbs 22, 26 are configured so as not to direct glare to areas adjacent to bed 200 so as to allow other beds (not shown) to be placed proximate thereto without undue disturbance of neighboring patients.

Examination light reflector 28 is outwardly adjacent to ambient light reflector 24, includes short side 18 and is opposite from reading light reflector 20. Examination light reflector 28 includes two to four fluorescent bulbs 30, 32. Fluorescent bulbs 30, 32 (preferably biax® or other U-shaped) are parallel to short sides 16, 18 of lighting fixture 10. As fluorescent bulbs 30, 32 have a characteristic directional light distribution pattern oriented in the direction perpendicular to the bulbs, the entire area of the bed 200 is efficiently illuminated. The bulbs 30, 32 and reflector 28 are chosen to provide 100 foot-candles of illumination to the bed 200. An important feature of the present invention resides in the orientation of the lamps within the lighting 1 fixture which permits the lighting fixture 10 to be packaged in a two foot by four foot configuration and thereby replace a conventional troffer.

Bulbs 22, 26, 30 and 32 are powered by a single electrical source, preferably supplied from wiring within ceiling 100 although the use of a single electric cord (not shown) engaging an electrical socket (not shown) may be used. A single switch module (not shown), either hand-held or built into wall 300, is used to control bulbs 22 and 26 and a wall switch to control bulbs 30 and 32.

To use this device, the patient operates the switch module (not shown) to operate selectively bulbs 22 and 26. Medical personnel control bulbs 30 and 32 of the examination lighting from a switch on the headwall, not easily accessible to the patient.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A medical lighting system comprising:

a body;

means for ceiling-mounting said body;

a first light fixture within said body oriented to direct light downwardly to a selected reading area under said body;

a second light fixture within said body oriented to direct light downwardly and outwardly to a vertical wall surface outwardly adjacent from said body whereby light is reflected back to a broad area under said body.

2. The medical lighting system of claim 1 wherein said first light fixture includes a first reflector and a first fluorescent bulb therewithin; and said second light fixture includes a second reflector and a second fluorescent bulb therewithin.

3. A medical lighting system comprising:

a body;

means for ceiling-mounting said body;

a first light fixture within said body oriented to direct light downwardly to a selected reading area under said body;

a second light fixture within said body oriented to direct light downwardly and outwardly to a vertical wall surface outwardly adjacent from said body whereby light is reflected back to a broad area under said body;

a third light fixture within said body oriented to direct light downwardly under said body to a selected patient examination area.

4. The medical lighting system of claim 3 wherein said first light fixture includes a first reflector and a first fluorescent bulb therewithin; said second light fixture includes a second reflector and a second fluorescent bulb therewithin; and said third light fixture includes a third reflector and a fluorescent assembly therewithin.

5. The medical lighting system of claim 4 wherein said fluorescent assembly includes at least one fluorescent bulb with a light distribution pattern oriented in a direction perpendicular to said at least one fluorescent bulb.

6. The medical lighting system of claim 5 wherein said at least one fluorescent bulb is a "biax"-type bulb.

7. The medical lighting system of claim 5 wherein said fluorescent assembly includes at least two fluorescent bulbs with a light distribution pattern oriented in a direction perpendicular to said at least two fluorescent bulbs.

8. The medical lighting system of claim 7 wherein said at least two fluorescent bulbs are "biax"-type bulbs.

9. The medical lighting system of claim 5 wherein said body is rectangular and a first shorter and of said body is designed to abut the vertical wall surface; wherein said first fluorescent light fixture abuts said first snorter end and said first fluorescent light bulb is parallel to said first shorter end; wherein said second fluorescent light fixture is inwardly adjacent to said first fluorescent light fixture and said second fluorescent light fixture is parallel to first shorter end; and wherein said third fluorescent light fixture is outwardly adjacent from said second fluorescent light fixture and abuts a second shorter end of said body; and wherein said at least one fluorescent bulb is parallel to said first shorter end.

10. The medical lighting system of claim 9 wherein said first and second shorter ends are substantially two feet in length and said body includes first and second longer ends which are substantially four feet in length.

11. The medical lighting system of claim 9 wherein said first light fixture illuminates said selected reading area to substantially 70 foot-candles; wherein said second light fixture illuminates said broad area to substantially 50 foot-candles; and wherein said third light fixture illuminates said patient examination area to substantially 100 foot-candles.

12. The medical lighting system of claim 11 wherein said patient examination area is sufficient in size to include a standard hospital bed when said first light fixture is substantially directly over a head of the standard hospital bed, the head of the standard hospital bed substantially abutting the vertical wall surface.

13. The medical lighting system of claim 3 wherein a distribution of light from said first and second light fixtures excludes glare from being directed to a forward area of a standard hospital bed placed below the medical lighting system.

14. The medical lighting system of claim 3 wherein a distribution of light from said first and second light fixtures excludes glare from areas adjacent to a standard hospital bed placed below the medical lighting system.

* * * * *